United States Patent [19]

Iverson

[11] 4,328,904

[45] May 11, 1982

[54] SPILL PROOF CONTAINER AND CLOSURE

[76] Inventor: Elaine J. Iverson, R.F.D. 2, Box 231, Warrenton, Va. 22186

[21] Appl. No.: 231,172

[22] Filed: Feb. 3, 1981

[51] Int. Cl.[3] ..... B65D 51/18; A45C 11/00

[52] U.S. Cl. ..... 220/256; 206/315 R; 150/3; 150/51

[58] Field of Search ..... 206/315, 525, 38; 220/256; 150/3, 51; 273/139

[56] References Cited

U.S. PATENT DOCUMENTS

| | | | |
|---|---|---|---|
| 527,202 | 10/1894 | Heywood et al. | 150/3 |
| 1,629,661 | 5/1927 | Gerhard | 273/139 |
| 1,983,139 | 12/1834 | Lovell | 220/256 |
| 2,528,332 | 10/1950 | Bergquist | 150/3 |
| 3,061,080 | 10/1962 | Stephen | 206/38 |
| 3,556,293 | 1/1971 | Schlueter | 206/525 |
| 4,246,945 | 1/1981 | Sterling | 150/51 |

*Primary Examiner*—William T. Dixson, Jr.
*Attorney, Agent, or Firm*—Birch, Stewart, Kolasch & Birch

[57] ABSTRACT

A spill proof container and closure for use therewith are disclosed. The closure incorporates a plurality of overlapping arcuate flaps of a resilient and flexible nature. Through the use of the overlapping, arcuate flaps a container embodying the closure of the present invention may be relatively tightly sealed to prevent spillage and in addition, may be directly accessed by the user by the penetration of the user's hand through the approximate center of the closure surface. Although the closure is intended for use with the container, the closure may be used for a variety of purposes.

27 Claims, 6 Drawing Figures

SPILL PROOF CONTAINER AND CLOSURE

FIELD OF THE INVENTION

This invention relates to a spill-proof container and its novel closure which provides direct entry and egress for the hands of the operator while providing a sealing closure which prevents spillage of the contents of the container.

BACKGROUND OF THE INVENTION

Many types of containers and closures are well known in the prior art. For example, a cylindrical container with a screw on or snap on lid has been widely used to store a variety of items. However, these screw on and snap on container closures exhibit a significant disadvantage. When the container is opened to gain access to the contents thereof, there is an exposure of the contents to spillage through the open aperture created by removal of the closure. While this problem may be considered only an inconvenience by adults, the problem is a significant one when the container is primarily intended for use by small children.

U.S. Pat. No. 3,116,927 to Kuhlman discloses a storage for dispensing container particularly adapted for use in storing game tiles to be utilized in the game disclosed in this patent. The container disclosed in the Kuhlman patent uses a slitted resilient diaphragm to access its interior. However, the Kuhlman patent does not provide the improved seal provided by the present invention. Further, the Kuhlman reference is not designed as a spill proof container particularly adapted for use with small children.

OBJECTS OF THE INVENTION

It is therefore an object of the present invention to provide a novel closure structure for direct access therethrough by the hands of a user while maintaining a substantially continuous seal therethrough.

Another object of the present invention is to provide a canister which allows a user direct entry and egress therefrom while preventing the spillage of objects located therein.

It is a further object of the present invention to provide a portable container for small solids which can be selectively accessed and from which it is difficult or impossible for solids to spill.

It is a still further object of the present invention to provide a portable container which may be used by children to carry small objects, the contents of which may be easily accessed by children without accidental spillage of the contents therefrom, both during entry and after egress where the closure reseals itself.

SUMMARY OF THE INVENTION

The objects of the present invention are fulfilled by a novel closure structure particularly adapted for the use in a container according to the present invention. The container of the present invention is a portable container or canister for small solids, which allows direct entry and egress by the user without spillage of the contents of the container. The container closure includes a series of flexible, resilient flaps which cover the closure opening. These flaps overlap and converge at the center of the closure opening and will easily yield to the pressure of the hand pressing down through them, allowing the user to reach the contents of the canister while preventing the contents of the canister from escaping through the closure. The resilient, flexible flaps will close to create a substantially planar closure surface once the user's hand is withdrawn. The overlap created by the resilient, flexible flaps of the present invention more securely maintains the contents therein while still allowing the user direct entry and egress through the closure. The container or canister of the present invention is particularly adapted to allow small children to carry their snacks or small toys to any desired place without the fear that the container or canister will be accidentally dropped or tipped over, enabling the contents to spill and scatter.

BRIEF DESCRIPTION OF THE DRAWINGS

Other objects of the present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
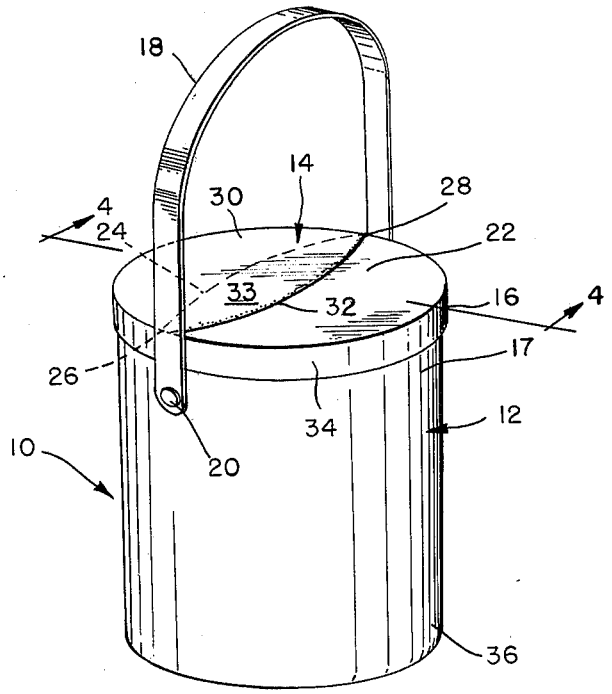
FIG. 1 is a perspective view of the container or canister made according to the present invention.

Referring to FIG. 1, a spill proof container or canister (generally indicated as 10) is made up of a generally cylindrical container 12 and a spill proof closure 14 associated therewith. The generally cylindrical container 12 is formed with a generally cylindrical sidewall 13 and a substantially planar bottom surface 36. The spill proof closure 14 includes a cylindrical flange portion 16 encircling its periphery. The generally cylindrical flange portion 16 encircling the periphery of the spill proof closure 14 is formed only slightly larger in diameter than the generally cylindrical sidewall 13 of the generally cylindrical container 12. The cylindrical flange portion 16 interacts with a top surface portion 17 of the generally cylindrical sidewall 13 in any desired manner, for example by snap or screw thread attachment. Any manner of attachment may be used, as long as the spill proof closure 14 is securely attached to the generally cylindrical container 12.

Figure 4:
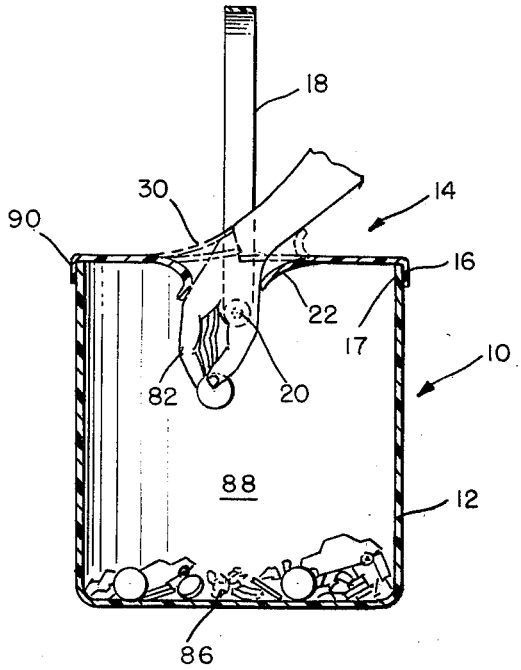
FIG. 4 is a schematic sectional side view of the container of FIG. 1 illustrating the parting of the resilient, flexible flaps by a user's hand in order to provide an entry into the interior of the container.

In the embodiment illustrated in FIG. 1, the spill proof container or canister 10 further includes a carrying handle 18 pivotably mounted on a pair of handle pivots 20 as shown in FIG. 4.

The operable portion of the spill proof closure 14 as illustrated in FIG. 1 is a pair of resilient, flexible closure flaps 22, 30. These flaps can be formed of any resilient, flexible and pliable sheet material, for example synthetic or natural rubber. The first and second resilient flexible closure flaps 22, 30 are positively affixed to an upper periphery 34 of cylindrical flange portion 16. The first resilient, flexible closure flap 22 includes a first arcuate lip portion 24 while the second resilient, flexible closure flap 30 includes a second arcuate lip portion 32. A closure overlap area 33 is defined by the area between the respective arcuate lip portions 24, 32 of the resilient, flexible closure flaps 22, 30. The closure overlap area 33 of the spill proof closure of the present invention provides a useful improvement over prior art closures by more securely sealing the contents of a container embodying the enclosure while still allowing direct access by the hand of a user as shown in FIG. 4. While in the preferred embodiment of FIG. 1, the lip portion 24 and 32 are arcuate, other arrangements may be formed according to the present invention. However, the use of the arcuate lip portions 24 and 32 producing the closure overlapping area 33 produces a particularly effective spill proof seal while still allowing simple and direct access as shown in FIG. 4. In order to assure simple and direct access, according to the teachings of the present invention, it is advantageous to allow the arcuate lip portions 24 and 32 to intersect at a pair of closure flap intersect points 26 and 28 equi-spaced about the circumference of the upper periphery 34 of the cylindrical flange portion 16. This intersection of the arcuate closure flaps portion 24, 32 at a pair of closure flap intersection points 26, 28 reduces the effort necessary to access the interior of the spill proof container or canister 10. However, the first and second arcuate closure lip portions 24 and 32 need not intersect at the pair of closure flap intersection points 26, 28. Instead, the closure overlap area 33 may be enlarged by allowing the flexible closure flaps 22, 30 to overlap somewhat at their point of intersection (26 or 28) with the upper periphery 34 of the cylindrical flange portion 16.

The generally cylindrical container 12 of the present invention may be made out of any suitable material. Also, while the preferred embodiment the container is cylindrical, the container may be constructed to any desired dimensions or shapes according to the present invention. The generally cylindrical container 12 may be constructed of a light weight plastic material which is either opaque or transparent.

Referring to FIG. 4, the operation of a spill proof container 10 similar to that illustrated in FIG. 1 will now be disclosed. In FIG. 4, a user's hand 82 is shown partially inserted into the interior 88 of the spill proof container or canister 10. In FIG. 4, a plurality of small toys 86, for example, toy cars, colored crayons, pencils, or puzzles are positioned within the interior 88 of the spill proof container 10. The spill proof container or canister 10 may be used to store a variety of articles, such as snacks or other small articles. In FIG. 4 the user's hand is being inserted as shown by the downward displacement of the resilient, flexible closure flaps 22, 30. Thus, the user's hand 82 is placing an article 84 into the spill proof container 10. As the user withdraws his hand 82 from the spill proof container 10, the resilient, flexible closure flaps 22, 30 partially withdraw to the position shown in phantom lines on drawing FIG. 4. When the user's hand is completely withdrawn, the resilient, flexible closure flaps 22, 30 return to the position shown in FIG. 1.

Figure 2:
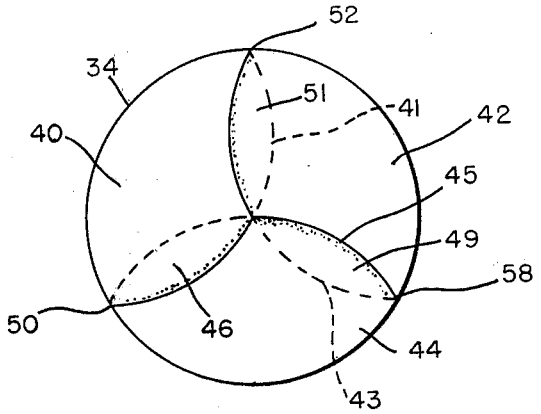
FIG. 2 is a schematic top view of one form of closure which may be used in the embodiment of FIG. 1.

FIG. 2 shows an additional embodiment of the spill proof closure 14 of FIG. 1 as taught by the present invention. Here, first, second, and third resilient, flexible closure flaps 40, 42, and 44 are positively fixed to the upper periphery 34 of cylindrical flanged portion 16. Each of the resilient, flexible closure flaps 40, 42, 44 has an arcuate lip portion 41, 43, 45, respectively. The resilient, flexible closure flaps overlap to form a plurality of overlap areas equal to the number of flaps used. In the FIG. 2 embodiment, a plurality of closure overlap areas 46, 49 and 51 are produced by the intersection of the resilient, flexible closure flaps 40, 42, 44. The arcuate lip portions 41, 43, 45 of the respective resilient flexible closure flaps 40, 42, 44 intersect at a plurality of closure flap intersection points 50, 52, 58 which are equispaced around the circumference of the upper periphery 34 of the cylindrical flange portion 16. As in the FIG. 1 embodiment, it is desirable to have an actual intersection of the arcuate lip portions 41, 43, 45 in order to facilitate entry into the container. However, the arcuate lip portions 41, 43, 45 of the respective resilient, flexible closure flaps 40, 42, and 44 need not intersect, but instead may overlap by a desired amount. While this overlap renders the closure more difficult to enter, the closure does remain functional.

Figure 3:
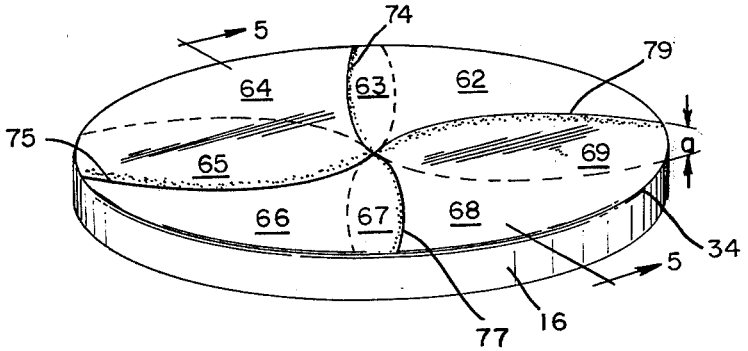
FIG. 3 is a perspective view of another embodiment of the closure formed according to the present invention.

FIG. 3 illustrates another embodiment of the present invention wherein four resilient, flexible closure flaps 62, 64, 66 and 68 are utilized. Again, as in the embodiments of FIGS. 1 and 2 and the flexible closure flaps 62, 64, 66 and 68 are positively affixed to the upper periphery 34 of the cylindrical flanged portion 16. The resilient, flexible closure flaps overlap to form a plurality of closure overlap areas 63, 65, 67, 69 which are defined by the arcuate lip portions 74, 75, 77, 79 of the respective resilient, flexible closure flaps 62, 64, 66, 68. As in the FIGS. 1 and 2 embodiments, it is desirable for the arcuate closure flaps lip portions to intersect at their point of contact with the upper periphery 34 of the cylindrical flange portions 16. However, the FIG. 3 embodiment illustrates an alternative construction where the overlap between adjacent flaps is present, even at the intersection of the respective flaps with the upper periphery 34 of the cylindrical flange portions 16. While the presence of flap overlap where the flap meets the upper periphery 34 of the cylindrical flange portion 16 provides a better closure seal, the difficulty in accessing a container through a closure with such a peripheral overlap is correspondingly increased. Thus, it may be desirable in certain circumstances to have an overlap (small dimension a in FIG. 3) between the adjacent resilient, flexible closure flaps (in this case, 62, 68) in order to produce a closure with a better seal, even at the expense of increasing the difficulty of opening the spill proof closure.

It should be understood that the radius of the arc formed by the arcuate lip portions of FIGS. 1–3 may be varied as required by the particular design. In the FIG. 1 embodiment, the arc may be virtually any finite radius greater than that of the cylindrical flange portion 16. The FIGS. 2 and 3 embodiments require an arcuate lip portion radius which will allow the resilient, flexible closure flaps to provide substantially complete closure of the planar surface described by the upper periphery 34 of the cylindrical flange portions 16.

Figure 5:
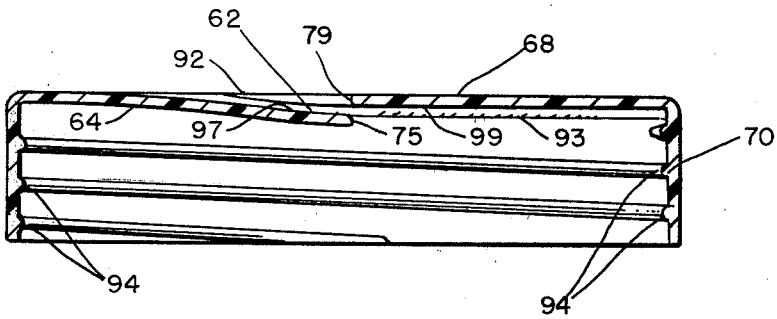
FIG. 5 is a sectional side view of FIG. 3 as taken along line 4—4 of FIG. 3.

FIG. 5 illustrates a side sectional view of the FIG. 3 embodiment illustrating one type of fastener used to fasten the spill proof closure 14 to the generally cylindrical container 12. FIG. 5 illustrates a plurality of screw threads 94 which are designed to communicate with corresponding threads present on the top surface portion 17 of the generally cylindrical container 12. FIG. 5 also illustrates the interleaved overlap of the flexible, resilient closure flaps 62, 64, 66, 68. As can be seen from an examination of FIG. 3 in conjunction with FIG. 5, each of the closure flaps 62, 64, 66 and 68 overlaps the bottom portion of one of its adjacent closure flaps while overlapping the top portion of the other of its adjacent closure flaps. FIG. 5 illustrates this arrangement of the resilient, flexible closure flaps 62 particularly well. Here, resilient flexible closure flap 62 is provided with a top surface 92 which communicates with the bottom surface 99 of another one of the resilient, flexible closure flaps 68. A bottom surface 93 of the resilient, flexible closure flap 62 communicates with a top surface 97 of still another of the resilient, flexible closure flap 64. FIG. 5 also illustrates the lack of a central overlap between the arcuate lip portions (for example, 75, 79) of their respective resilient, flexible closure flaps 64, 68 at a point at the center of the closure.

Figure 6:
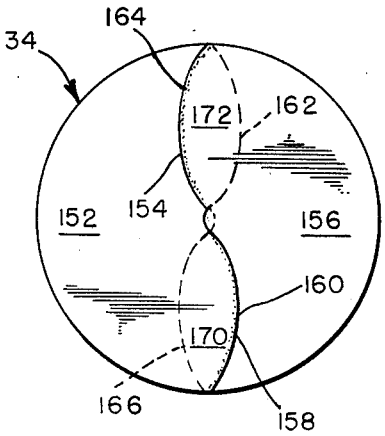
FIG. 6 is a top schematic view of another embodiment of enclosure formed according to the present invention.

FIG. 6 shows an additional, alternative embodiment of the closure of FIG. 1 embodying only two resilient, flexible closure flaps. In this embodiment, first and second, resilient flexible closure flaps 152, 156 are positively fixed to the upper periphery 34 of the cylindrical flange portion 16. However, in the embodiment of FIG. 6, each of the resilient, flexible closure flaps 152, 156 includes a respective compound arcuate lip portion 154, 158. The compound arcuate lip portion 158 associated with the first resilient, flexible closure flap 152 includes a first upper arcuate lip portion 160 and a first lower arcuate lip portion 162. Similarly, the second resilient, flexible closure flap 156 includes a compound arcuate lip portion 154 including a second upper arcuate lip portion 164 and a second lower arcuate lip portion 166. The first upper lip portion 160 and the second lower lip portion 166 define an overlap between the resilient flexible closure flaps to create a first closure overlap area 170. Similarly, the second upper arcuate flap portion 164 and the first lower arcuate flap portion 162 define a second closure overlap area 172 between the respective resilient, flexible closure flaps 152, 156. It is readily apparent from FIG. 6 that in overlap area 170, the first flexible, resilient closure flap 152 is positioned over the second resilient, flexible closure flap 156 in the first overlap area 170 while the opposite is true in the second overlap area 172. Because of the alternating overlap provided by the FIG. 6 embodiment, a more secure closure seal is created.

From an examination of the disclosure and drawings of the present application it is evident that the present invention may be modified as would occur to one of ordinary skill in the art without departing from the spirit and scope of this invention. For example, more than four flaps may be used to form an embodiment of the present invention. Also, the container adapted for use with the closures of the present invention could be provided with weighted bottom to stabilize the container or canister and thus adapt the container to many office, shop and home uses.

I claim:

1. A spill proof closure comprising:

a peripheral support surface defining a planar closure area; and at least two resilient, flexible flaps mounted to said support surface, said flaps substantially covering said planar closure area, each of said flaps having an unsupported non-linear edge, said flaps being overlapped and forming at least one overlapping area defined by said unsupported nonlinear edges, edge of said unsupported nonlinear edges intersecting said peripheral support surface at two intersection points, the nonlinearity of said unsupported nonlinear edges being so configured as to optimize the overlap area to provide an enhanced seal.

2. The closure of claim 1 wherein said peripheral support surface is annular in shape.

3. The closure of claim 2 wherein said nonlinear edges are arcuate in shape.

4. The closure of claim 3 wherein said closure includes two resilient flexible closure flaps.

5. The closure of claim 4 wherein said intersection points of one of said resilient flexible flaps correspond to the intersection points of the other of said resilient flexible flaps.

6. The closure of claim 3 wherein said closure includes more than two resilient flexible closure flaps;

said nonlinear edges of said flaps each defining two overlapping areas.

7. The closure of claim 6 wherein each of said flaps is disposed over one adjacent flap in one overlap area and disposed under another adjacent flap in the other overlap area.

8. The closure of claim 7 wherein each intersection point of each flap corresponds to an intersection point of an adjacent flap.

9. The closure of claim 2 wherein said nonlinear edges include at least two arcuate edge segments.

10. The closure of claim 9 wherein said flaps are overlapped to form overlapped areas defined by the arcuate edge segments of said flaps.

11. The closure of claim 10 wherein the portion of one of said flaps adjacent to one of said edge segments is disposed over a corresponding portion of the other of said flaps at one of said overlapping areas and adjacent portions of said one of said flaps are disposed under their corresponding portions of the other of said flaps in an adjacent overlapping area.

12. A spill proof container comprising a receptacle including sides and a bottom; and a top including a spill proof closure means incorporated therein for sealing said container and allowing selective entry and egress, said closure including:

a peripheral support surface defining a planer closure area; and at least two resilient flexible flaps mounted to said support surface, said flaps substantially covering said planar closure area, each of said flaps having an unsupported nonlinear edge, said flaps being overlapped and forming at least one overlapping area defined by said unsupported nonlinear edges, each of said unsupported nonlinear edges intersecting said peripheral support surface at two intersection points, the nonlinearity of said unsupported nonlinear edges being so configured as to optimize the overlap area to provide an enhanced seal.

13. The container of claim 12 wherein said peripheral support surface is annular in shape.

14. The container of claim 13 wherein said nonlinear edges are arcuate in shape.

15. The container of claim 14 wherein said closure includes two resilient flexible closure flaps.

16. The container of claim 15 wherein said intersection points of one of said resilient flexible flaps correspond to the intersection points of the other of said resilient flexible flaps.

17. The container of claim 14 wherein said closure includes more than two resilient flexible closure flaps;

said nonlinear edges of said flaps each defining two overlapping areas.

18. The container of claim 17 wherein each of said flaps is disposed over an adjacent flap in one overlap area and disposed under the adjacent flap in the other overlap area.

19. The container of claim 18 wherein each intersection point of each flap corresponds to an intersection point of an adjacent flap.

20. The closure of claim 13 wherein said nonlinear edges include at least two arcuate edge segments.

21. The closure of claim 20 wherein said flaps are overlapped to form overlapping areas defined by each of the arcuate edge segments of one of said flaps.

22. The closure of claim 21 wherein the portion of one of said flaps adjacent to one of said edge segments is disposed over a corresponding portion of the other of said flaps at one of said overlapping areas and adjacent portion of said one of said flaps are diposed under their corresponding portions of the other of said flaps in an adjacent overlapping area.

23. The container of claim 12 wherein said receptacle is generally cylindrical in shape.

24. The container of claim 23 wherein said receptacle is transparent.

25. The container of claim 23 wherein said receptacle is opaque.

26. The container of claim 23 wherein said container includes a weighted bottom.

27. The container of claim 24 further comprising a handle positively affixed to said receptacle.

* * * * *